US011885343B2

(12) United States Patent
Sakisaka et al.

(10) Patent No.: US 11,885,343 B2
(45) Date of Patent: Jan. 30, 2024

(54) CENTRIFUGAL COMPRESSOR

(71) Applicant: IHI Corporation, Tokyo (JP)

(72) Inventors: Ryota Sakisaka, Tokyo (JP); Takashi Fujiwara, Tokyo (JP); Atsushi Yonemura, Tokyo (JP); Takahiro Bamba, Tokyo (JP)

(73) Assignee: IHI Corporation, Tokyo (JP)

( * ) Notice: Subject to any disclaimer, the term of this patent is extended or adjusted under 35 U.S.C. 154(b) by 101 days.

(21) Appl. No.: 17/643,943

(22) Filed: Dec. 13, 2021

(65) Prior Publication Data

US 2022/0099101 A1 Mar. 31, 2022

Related U.S. Application Data

(63) Continuation of application No. PCT/JP2020/037894, filed on Oct. 6, 2020.

(30) Foreign Application Priority Data

Oct. 9, 2019 (JP) ..... 2019-185786

(51) Int. Cl.
*F04D 29/46* (2006.01)
*F04D 27/02* (2006.01)
(Continued)

(52) U.S. Cl.
CPC ..... *F04D 27/0253* (2013.01); *F04D 17/10* (2013.01); *F04D 27/003* (2013.01);
(Continued)

(58) Field of Classification Search
CPC .... F04D 29/685; F04D 29/464; F04D 29/667; F04D 29/462; F04D 29/4213;
(Continued)

(56) References Cited

U.S. PATENT DOCUMENTS 4,122,668 A * 10/1978 Chou ..... F01D 21/006 188/290
6,375,155 B1 * 4/2002 Janssens ..... F16L 55/10 251/212
(Continued)

FOREIGN PATENT DOCUMENTS

JP 2009-236035 A 10/2009
WO WO 2012/161283 A1 11/2012
(Continued)

OTHER PUBLICATIONS

International Search Report dated Dec. 8, 2020 in PCT/JP2020/037894 filed on Oct. 6, 2020, 4 pages (with English Translation).
(Continued)

*Primary Examiner* — Woody A Lee, Jr.
*Assistant Examiner* — Behnoush Haghighian
(74) *Attorney, Agent, or Firm* — Oblon, McClelland, Maier & Neustadt, L.L.P.

(57) ABSTRACT

A centrifugal compressor includes: a housing including an intake flow path; a compressor impeller disposed in the intake flow path; an accommodation chamber formed upstream of the compressor impeller in the housing; a movable member disposed in the accommodation chamber and configured to be movable between a retracted position where the movable member is retracted from the intake flow path and a protruding position where the movable member protrudes from the accommodation chamber into the intake flow path, the protruding position being located closer to the intake flow path with respect to the retracted position, and a contacting portion and a non-contacting portion provided on an accommodation chamber opposing surface of the accommodation chamber, the accommodation chamber opposing surface being positioned upstream of the movable member, the contacting portion being contactable with the movable
(Continued)

member, the non-contacting portion being non-contactable with the movable member.

6 Claims, 9 Drawing Sheets

(51) Int. Cl.

| | |
|---|---|
| ***F04D 17/10*** | (2006.01) |
| ***F04D 27/00*** | (2006.01) |
| *F01D 17/14* | (2006.01) |
| *F04D 29/42* | (2006.01) |
| *F04D 29/68* | (2006.01) |
| *F04D 29/66* | (2006.01) |

(52) U.S. Cl.
CPC ..... *F01D 17/141* (2013.01); *F04D 29/4213* (2013.01); *F04D 29/464* (2013.01); *F04D 29/667* (2013.01); *F04D 29/685* (2013.01)

(58) Field of Classification Search
CPC .. F04D 29/444; F04D 27/002; F04D 27/0207; F04D 27/0215; F04D 27/0246; F04D 27/0253; F04D 27/023; F04D 27/0238; F01D 17/141; F01D 17/145; F01D 17/146
See application file for complete search history.

(56) References Cited

U.S. PATENT DOCUMENTS

| | | | | |
|---|---|---|---|---|
| 8,196,610 | B2 * | 6/2012 | Murakami | H05K 7/20272 138/45 |
| 8,316,820 | B1 * | 11/2012 | Cammarata | F02D 9/12 251/304 |
| 9,568,111 | B2 * | 2/2017 | Daniels | F16K 3/0227 |
| 9,764,908 | B2 * | 9/2017 | Lin | B65G 53/40 |
| 10,393,009 | B2 * | 8/2019 | Mohtar | F04D 29/464 |
| 10,400,789 | B2 * | 9/2019 | Harley | F04D 29/284 |
| 10,465,706 | B2 * | 11/2019 | Lombard | F02B 37/00 |
| 10,495,100 | B2 * | 12/2019 | Mohtar | F04D 29/083 |
| 10,502,126 | B2 * | 12/2019 | Villemin | F16K 3/03 |
| 10,502,232 | B2 * | 12/2019 | Mohtar | F04D 29/462 |
| 10,544,808 | B2 * | 1/2020 | Mohtar | F16K 3/03 |
| 10,550,761 | B2 * | 2/2020 | Lombard | F04D 29/4206 |
| 10,570,905 | B2 * | 2/2020 | Mohtar | F04D 29/685 |
| 10,619,561 | B2 * | 4/2020 | Lombard | F04D 29/464 |
| 10,774,676 | B2 * | 9/2020 | Hu | F01D 17/165 |
| 10,774,677 | B2 * | 9/2020 | Hu | F04D 27/0253 |
| 10,883,418 | B2 * | 1/2021 | Hiller | F02B 37/16 |
| 11,105,218 | B2 * | 8/2021 | Karstadt | F04D 29/464 |
| 11,131,236 | B2 * | 9/2021 | Lombard | F04D 29/4206 |
| 11,415,149 | B2 * | 8/2022 | Karstadt | F04D 29/464 |
| 11,434,927 | B2 * | 9/2022 | Bogner | F04D 27/0253 |
| 11,591,926 | B2 * | 2/2023 | Stankevicius | F01D 25/24 |
| 2008/0192326 | A1 * | 8/2008 | Mizumaki | G03B 9/06 359/234 |
| 2009/0025416 | A1 * | 1/2009 | Murakami | F25B 41/20 62/324.6 |
| 2009/0095350 | A1 * | 4/2009 | Bauman | F16K 3/03 251/231 |
| 2015/0041695 | A1 * | 2/2015 | Daniels | F16K 3/03 251/212 |
| 2017/0298943 | A1 * | 10/2017 | Mohtar | F04D 29/464 |
| 2017/0320470 | A1 * | 11/2017 | Belanger | F04D 29/464 |
| 2018/0258842 | A1 * | 9/2018 | Villemin | F04D 29/464 |
| 2019/0048876 | A1 * | 2/2019 | Mohtar | F04D 27/0207 |
| 2019/0136755 | A1 * | 5/2019 | Lombard | F02C 6/12 |
| 2019/0178151 | A1 * | 6/2019 | Smith | F04D 27/0253 |
| 2019/0264604 | A1 * | 8/2019 | Lombard | F04D 29/464 |
| 2019/0264710 | A1 * | 8/2019 | Mohtar | F04D 29/464 |
| 2019/0271329 | A1 * | 9/2019 | Mohtar | F04D 29/464 |
| 2019/0368373 | A1 * | 12/2019 | Hu | F04D 27/0207 |
| 2019/0368374 | A1 * | 12/2019 | Hu | F04D 29/685 |
| 2020/0011196 | A1 * | 1/2020 | Karstadt | F02B 37/225 |
| 2020/0208651 | A1 * | 7/2020 | Bogner | F04D 29/4213 |
| 2020/0309141 | A1 * | 10/2020 | Vuletic | F04D 29/464 |
| 2020/0340497 | A1 * | 10/2020 | Lombard | F01D 9/04 |
| 2021/0088054 | A1 | 3/2021 | Sakisaka et al. | |
| 2021/0262483 | A1 * | 8/2021 | Henzler | F04D 29/663 |
| 2022/0090514 | A1 * | 3/2022 | Stankevicius | F01D 17/145 |
| 2022/0186747 | A1 * | 6/2022 | Lombard | F04D 29/464 |

FOREIGN PATENT DOCUMENTS

| | | |
|---|---|---|
| WO | WO 2018/106620 A1 | 6/2018 |
| WO | WO 2020/031507 A1 | 2/2020 |

OTHER PUBLICATIONS

Combined Chinese Office Action and Search Report dated Mar. 8, 2023 in Patent Application No. 202080042603.1 (with English translation of Category of Cited Documents), 6 pages.

* cited by examiner

CENTRIFUGAL COMPRESSOR

CROSS REFERENCE TO RELATED APPLICATIONS

This application is a continuation application of International Application No. PCT/JP2020/037894, filed on Oct. 6, 2020, which claims priority to Japanese Patent Application No. 2019-185786, filed on Oct. 9, 2019, the entire contents of which are incorporated by reference herein.

BACKGROUND ART

Technical Field

The present disclosure relates to a centrifugal compressor.

A centrifugal compressor includes a compressor housing in which an intake flow path is formed. A compressor impeller is arranged in the intake flow path. When a flow rate of air flowing into the compressor impeller is reduced, air compressed by the compressor impeller flows backward in the intake flow path, causing a phenomenon called surging.

Patent Literature 1 discloses a centrifugal compressor having a throttling mechanism in a compressor housing. The throttling mechanism comprises a movable member. The movable member is configured to be movable between a protruding position in which the movable member protrudes into an intake flow path, and a retracted position in which the movable member is retracted from the intake flow path. The throttling mechanism reduces the flow path cross-sectional area of the intake flow path by causing the movable member to protrude into the intake flow path. When the movable member protrudes into the intake flow path, the air flowing backward in the intake flow path is blocked by the movable member. The blocking of the air flowing backward in the intake flow path inhibits surging.

CITATION LIST

Patent Literature

Patent Literature 1: JP 2009-236035 A

SUMMARY

Technical Problem

The movable member is pressed against a wall surface of the compressor housing positioned upstream in a flow of intake air, by the air flowing backward in the intake flow path. In this state, the frictional force between the wall of the compressor housing and the movable member increases. As a result, a load on the throttling mechanism increases when the movable member is driven.

An object of the present disclosure is to provide a centrifugal compressor capable of reducing a load for driving a movable member.

Solution to Problem

In order to solve the above problem, a centrifugal compressor according to one aspect of the present disclosure comprises: a housing including an intake flow path; a compressor impeller disposed in the intake flow path; an accommodation chamber formed upstream of the compressor impeller in a flow of an intake air in the housing; a movable member disposed in the accommodation chamber, and a contacting portion and a non-contacting portion provided on an accommodation chamber opposing surface of the accommodation chamber, the accommodation chamber opposing surface being positioned upstream of the movable member.

The contacting portion may be arranged at the radially innermost area of the accommodation chamber opposing surface.

The non-contacting portion may communicate with the intake flow path.

Effects of Disclosure

According to the present disclosure, a load for driving a movable member can be reduced.

DESCRIPTION OF EMBODIMENTS

Embodiments of the present disclosure will be described in detail below with reference to the accompanying drawings. Specific dimensions, materials, and numerical values, etc. shown in the embodiments are merely examples for a better understanding, and do not limit the present disclosure unless otherwise specified. In this specification and the drawings, duplicate explanations are omitted for elements having substantially the same functions and configurations by affixing the same reference sign. In addition, elements not directly related to the present disclosure are omitted from the figures.

Figure 1:
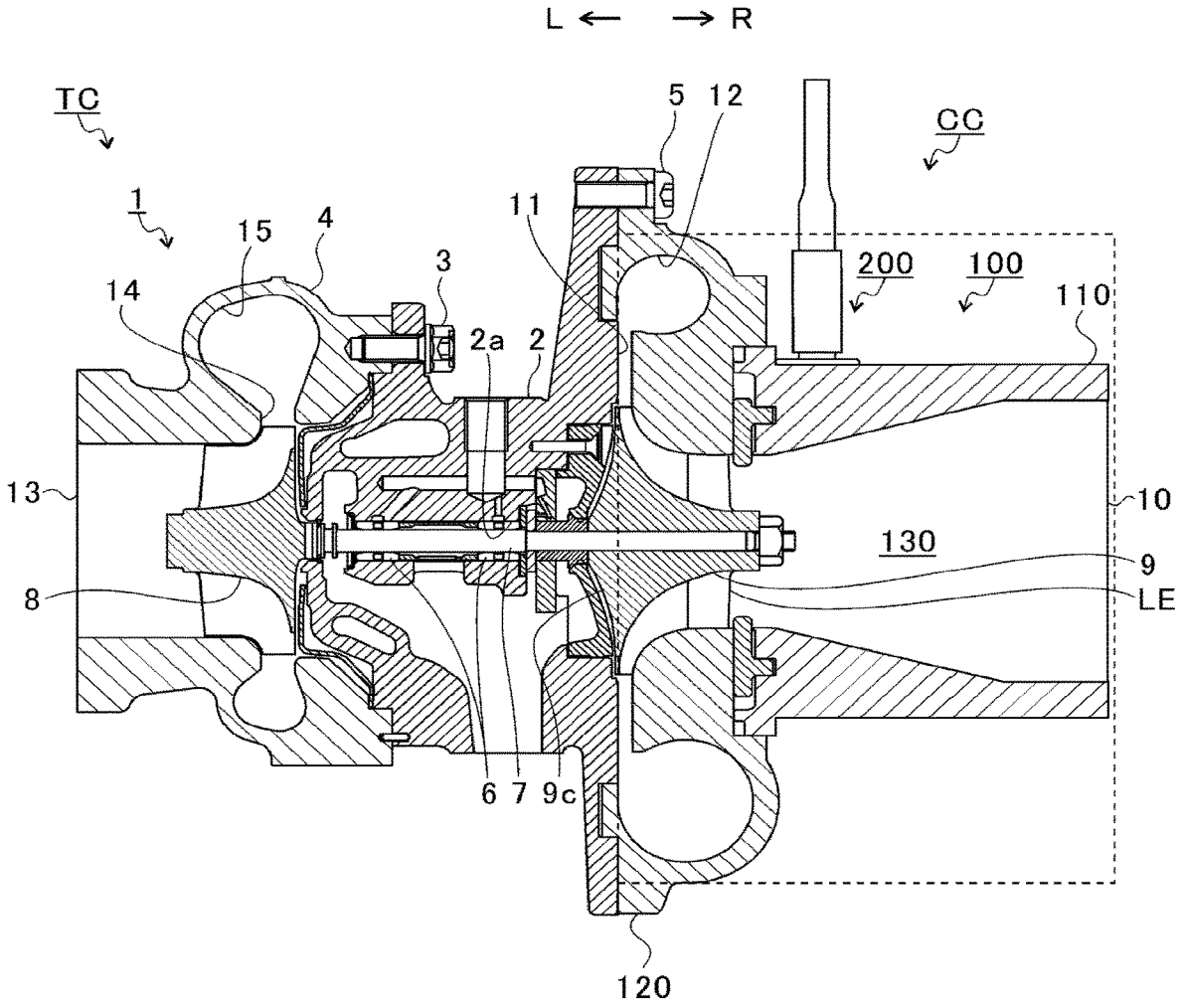
FIG. 1 is a schematic cross-sectional view of a turbocharger.

FIG. 1 is a schematic cross-sectional view of a turbocharger TC. A direction indicated by an arrow L shown in FIG. 1 is described as the left side of the turbocharger TC. A direction indicated by an arrow R shown in FIG. 1 is described as the right side of the turbocharger TC. In the turbocharger TC, a part including a compressor housing 100 (described below) functions as a centrifugal compressor CC. Hereinafter, the centrifugal compressor CC will be described as being driven by a turbine impeller 8 which will also be described below. However, the centrifugal compressor CC is not limited thereto, and may be driven by an engine (not shown) or by an electric motor (motor) (not shown). Thus, the centrifugal compressor CC may be incorporated into a device other than the turbocharger TC, or may be a standalone device.

As shown in FIG. 1, the turbocharger TC comprises a turbocharger body 1. The turbocharger body 1 includes a bearing housing 2, a turbine housing 4, a compressor housing (housing) 100, and a link mechanism 200. Details of the link mechanism 200 will be described later. The turbine housing 4 is connected to the left side of the bearing housing 2 by a fastening bolt 3. The compressor housing 100 is connected to the right side of the bearing housing 2 by a fastening bolt 5.

An accommodation hole 2*a* is formed in the bearing housing 2. The accommodation hole 2*a* passes through in the left-to-right direction of the turbocharger TC. A bearing 6 is arranged in the accommodation hole 2*a*. In FIG. 1, a full-floating bearing is shown as an example of the bearing 6. However, the bearing 6 may be any other radial bearing, such as a semi-floating bearing or a rolling bearing. A portion of a shaft 7 is arranged in the accommodation hole 2*a*. The shaft 7 is rotatably supported by the bearing 6. A turbine impeller 8 is provided at the left end of the shaft 7. The turbine impeller 8 is rotatably housed in the turbine housing 4. A compressor impeller 9 is provided at the right end of the shaft 7. The compressor impeller 9 is rotatably housed in the compressor housing 100.

An inlet 10 is formed in the compressor housing 100. The inlet 10 opens to the right side of the turbocharger TC. The inlet 10 is connected to an air cleaner (not shown). A diffuser flow path 11 is formed between the bearing housing 2 and the compressor housing 100. The diffuser flow path 11 pressurizes air. The diffuser flow path 11 has an annular shape from an inner side to an outer side in a radial direction of the shaft 7 (compressor impeller 9) (hereinafter simply referred to as the radial direction). The diffuser flow path 11 is connected to the inlet 10 via the compressor impeller 9 at the inner side in the radial direction.

A compressor scroll flow path 12 is formed in the compressor housing 100. The compressor scroll flow path 12 is formed in an annular shape. The compressor scroll flow path 12 is, for example, positioned radially outside the compressor impeller 9. The compressor scroll flow path 12 is connected to an air intake of the engine (not shown) and to the diffuser flow path 11. When the compressor impeller 9 rotates, air is sucked into the compressor housing 100 from the inlet 10. The intake air is pressurized and accelerated when passing through the blades of the compressor impeller 9. The pressurized and accelerated air is further pressurized in the diffuser flow path 11 and the compressor scroll flow path 12. The pressurized air is discharged from a discharge port (not shown) and is led to the air intake port of the engine.

As described above, the turbocharger TC comprises the centrifugal compressor (compressor) CC. The centrifugal compressor CC includes the compressor housing 100, the compressor impeller 9, the compressor scroll flow path 12, and the link mechanism 200 described below.

An outlet 13 is formed in the turbine housing 4. The outlet 13 opens to the left side of the turbocharger TC. The outlet 13 is connected to an exhaust gas purification device (not shown). A connecting flow path 14 and a turbine scroll flow path 15 are formed in the turbine housing 4. The turbine scroll flow path 15 is positioned radially outside the turbine impeller 8. The connecting flow path 14 is positioned between the turbine impeller 8 and the turbine scroll flow path 15.

The turbine scroll flow path 15 is connected to a gas intake (not shown). Exhaust gas discharged from an exhaust manifold (not shown) of the engine is led to the gas intake. The connecting flow path 14 connects the turbine scroll flow path 15 with the outlet 13. The exhaust gas led from the gas intake to the turbine scroll flow path 15 is led to the outlet 13 through the connecting flow path 14 and between the blades of the turbine impeller 8. The exhaust gas rotates the turbine impeller 8 when passing therethrough.

The rotational force of the turbine impeller 8 is transmitted to the compressor impeller 9 via the shaft 7. As described above, the air is pressurized by the rotational force of the compressor impeller 9 and is led to the air intake of the engine.

Figure 2:
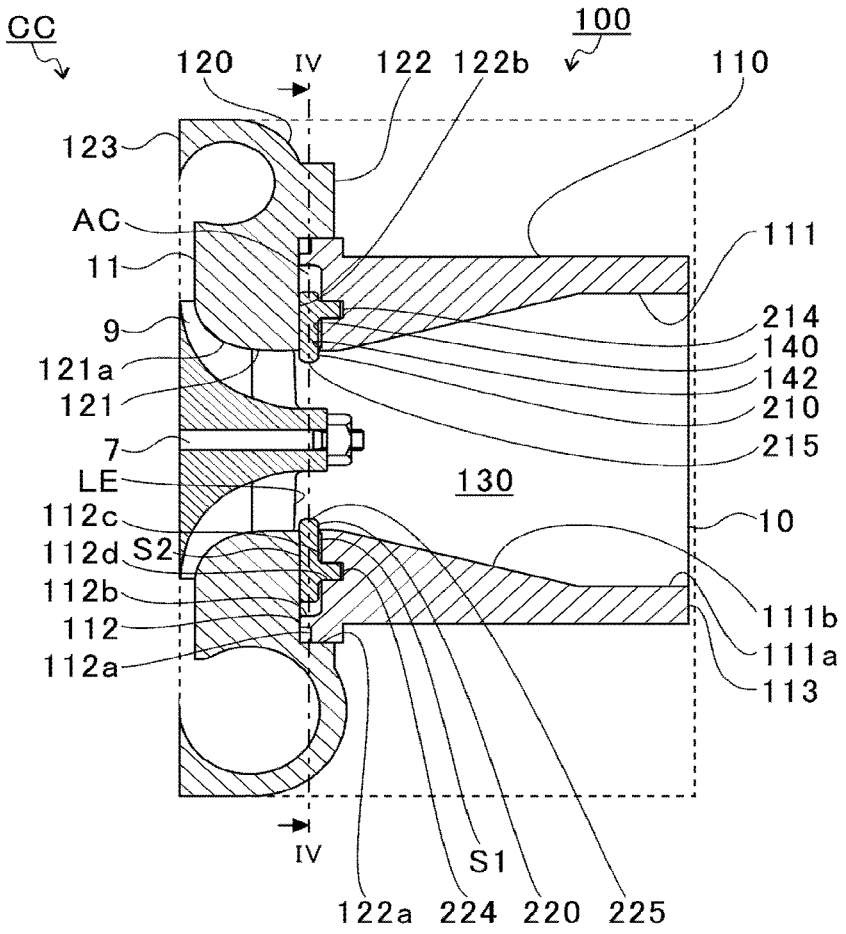
FIG. 2 is an extraction of a dashed area in FIG. 1.

FIG. 2 is an extraction of a dashed area in FIG. 1. As shown in FIG. 2, the compressor housing 100 includes a first housing member 110 and a second housing member 120. The first housing member 110 is positioned in the right side of the second housing member 120 in FIG. 2 (a side spaced apart from the bearing housing 2). The second housing member 120 is connected to the bearing housing 2. The first housing member 110 is connected to the second housing member 120.

The first housing member 110 has an approximately cylindrical shape. A through hole 111 is formed in the first housing member 110. The first housing member 110 includes an end surface 112 on a side that is proximate (connected) to the second housing member 120. The first housing member 110 includes an end surface 113 on a side that is spaced apart from the second housing member 120. The inlet 10 is formed on the end surface 113. The through hole 111 extends from the end surface 112 to the end surface 113 along a rotational axis direction of the shaft 7 (compressor impeller 9) (hereinafter simply referred to as the rotational axis direction). The through hole 111 penetrates the first housing member 110 in the rotational axis direction. The through hole 111 includes the inlet 10 at the end surface 113.

The through hole 111 includes a parallel portion 111*a* and a tapered portion 111*b*. The parallel portion 111*a* is positioned closer to the end surface 113 with respect to the tapered portion 111*b*. An inner diameter of the parallel portion 111*a* is substantially constant over the rotational axis direction. The tapered portion 111*b* is positioned closer to the end surface 112 with respect to the parallel portion 111*a*. The tapered portion 111*b* is continuous with the parallel portion 111*a*. In the tapered portion 111*b*, an inner diameter of a portion that is continuous with the parallel portion 111*a* is substantially equal to the inner diameter of the parallel portion 111*a*. The inner diameter of the tapered portion 111*b* decreases as being spaced apart from the parallel portion 111*a* (as approaching the end surface 112).

A notch portion 112*a* is formed on the end surface 112. The notch portion 112*a* is depressed from the end surface 112 toward the end surface 113. The notch 112*a* is formed on an outer periphery of the end surface 112. The notch portion 112*a* has, for example, a substantially annular shape when seen from the rotational axis direction.

An accommodation chamber AC is formed on the end surface 112. The accommodation chamber AC is formed closer to the inlet 10 of the first housing member 110 with respect to leading edges LE of the blades of the compressor impeller 9. The accommodation chamber AC includes an accommodation groove 112*b*, bearing holes 112*d*, and an accommodation hole 115 which will be described later.

The accommodation groove 112*b* is formed in the end surface 112. The accommodating groove 112*b* is positioned between the notch portion 112*a* and the through hole 111. The accommodation groove 112*b* is depressed from the end surface 112 toward the end surface 113. The accommodating groove 112*b* has, for example, a substantially annular shape when seen from the rotational axis direction. The accommodating groove 112*b* is connected to the through hole 111 at a radially inner side.

The bearing holes 112*d* are formed in a wall surface (accommodation chamber opposing surface) 112*c* on the end surface 113 side of the accommodation groove 112*b*. The bearing holes 112*d* extend in the rotational axis direction from the wall surface 112*c* toward the end surface 113. Two bearing holes 112*d* are provided with being spaced apart from each other in a rotational direction of the shaft 7 (compressor impeller 9) (hereinafter simply referred to as the rotational direction or a circumferential direction). The two bearing holes 112*d* are arranged at positions spaced apart from each other by 180 degrees in the rotational direction.

A through hole 121 is formed in the second housing member 120. The second housing member 120 includes an end surface 122 on a side proximate (connected) to the first housing member 110. The second housing member 120 also has an end surface 123 on a side spaced apart from the first housing member 110 (a side connected to the bearing housing 2). The through hole 121 extends from the end surface 122 to the end surface 123 along the rotational axis direction. The through hole 121 penetrates the second housing member 120 in the rotational axis direction.

An inner diameter of the through hole 121 at an end portion on the end surface 122 is substantially equal to the inner diameter of the through hole 111 at an end portion on the end surface 112. A shroud portion 121*a* is formed on an inner wall of the through hole 121. The shroud portion 121*a* faces the compressor impeller 9 from radially outside. An outer diameter of the compressor impeller 9 increases as being spaced apart from the leading edge LE of the compressor impeller 9. An inner diameter of the shroud portion 121*a* increases as being spaced apart from the end surface 122 (as approaching the end surface 123).

An accommodation groove 122*a* is formed on the end surface 122. The accommodation groove 122*a* is depressed from the end surface 122 toward the end surface 123. The accommodation groove 122*a* has, for example, a substantially annular shape when seen from the rotational axis direction. The housing member 110 is inserted into the accommodation groove 122*a*. A wall surface 122*b* is formed on the end surface 123 side of the accommodation groove 122*a*. The end surface 112 of the first housing member 110 contacts the wall surface 122*b*. In this state, the accommodation chamber AC is formed between the first housing member 110 (wall surface 112*c*) and the second housing member 120 (wall surface 122*b*).

The through hole 111 of the first housing member 110 and the through hole 121 of the second housing member 120 form an intake flow path 130. In this manner, the intake flow path 130 is formed in the compressor housing 100. The intake flow path 130 is connected from an air cleaner (not shown) to the diffuser flow path 11 through the inlet 10. An air cleaner side (inlet 10 side) of the intake flow path 130 is an upstream side of the intake air, and the diffuser flow path 11 side of the intake flow path 130 is a downstream side of the intake air.

The compressor impeller 9 is arranged in the intake flow path 130. A cross-sectional shape of the intake flow path 130 (through holes 111 and 121) perpendicular to the rotational axis direction has, for example, a circular shape centered on the rotational axis of the compressor impeller 9. However, the cross-sectional shape of the intake flow path 130 is not limited thereto, and may be, for example, an elliptical shape.

A sealing member (not shown) is disposed in the notch portion 112*a* of the first housing member 110. The sealing member reduces an air flow through a gap between the first housing member 110 and the second housing member 120. However, the notch portion 112*a* and the sealing member are not essential.

Figure 3:
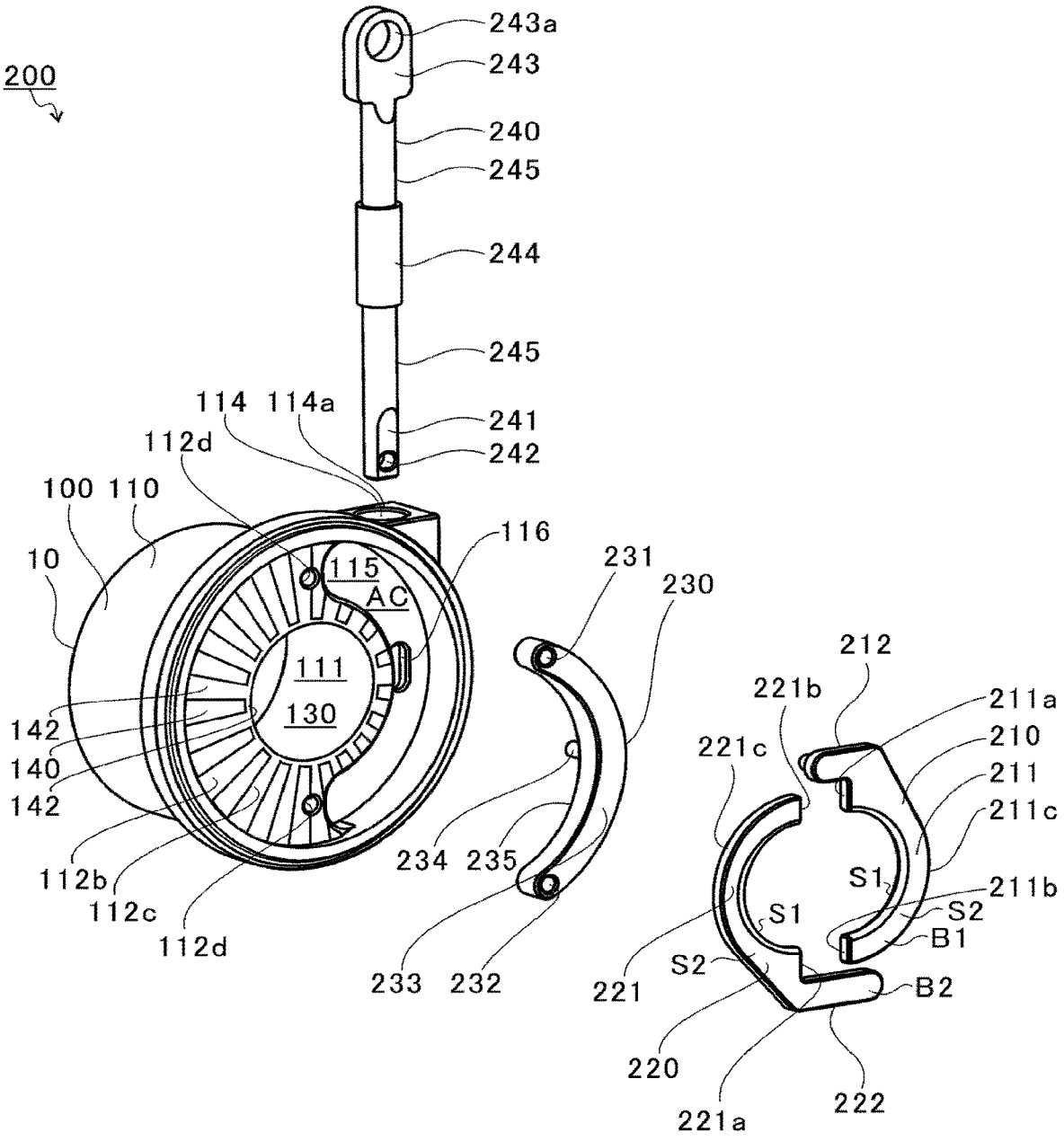
FIG. 3 is an exploded view of components of a link mechanism.

FIG. 3 is an exploded view of components of the link mechanism 200. In FIG. 3, only the first housing member 110 of the compressor housing 100 is shown. As shown in FIG. 3, the link mechanism 200 includes the first housing member 110, a first movable member 210, a second movable member 220, a connecting member 230, and a rod 240. In the intake flow path 130, the link mechanism 200 is arranged closer to the inlet 10 (the upstream side) with respect to the compressor impeller 9 in the rotational axis direction.

The first movable member 210 is disposed in the accommodation groove 112*b* (accommodation chamber AC). Specifically, the first movable member 210 is disposed between the wall surface 112*c* of the accommodation groove 112*b* and the wall surface 122*b* of the accommodation groove 122*a* (see FIG. 2) in the rotational axis direction. The first movable member 210 has an opposing surface (movable member opposing surface) S1 facing the wall surface 112*c* of the accommodation groove 112*b*. The first movable member 210 has an opposing surface S2 facing the wall surface 122*b* of the accommodation groove 122*a*. The first movable member 210 has a body portion B1. The body portion B1 includes a curved portion 211 and an arm portion 212.

The curved portion 211 extends in a circumferential direction of the compressor impeller 9. The curved portion 211 has a substantially semicircular arc shape. One end surface 211*a* and the other end surface 211*b* of the curved portion 211 in the circumferential direction extend parallel to the radial direction and the rotational axis direction. However, the one end surface 211*a* and the other end surface 211*b* may be inclined with respect to the radial direction and the rotational axis direction.

The arm portion 212 is provided on a side of the one end surface 211*a* of the curved portion 211. The arm portion 212 extends radially outward from an outer peripheral surface 211*c* of the curved portion 211. The arm portion 212 extends in a direction that is inclined with respect to the radial direction (toward the second movable member 220).

The second movable member 220 is disposed in the accommodation groove 112*b* (accommodation chamber AC). Specifically, the second movable member 220 is disposed between the wall surface 112*c* of the accommodation groove 112*b* and the wall surface 122*b* of the accommodation groove 122*a* (see FIG. 2) in the rotational axis direction. The second movable member 220 has an opposing surface (movable member opposing surface) S1 facing the wall surface 112*c* of the accommodation groove 112*b*. The second movable member 220 has an opposing surface S2 facing the wall surface 122*b* of the accommodation groove 122*a*. The second movable member 220 has a body portion B2. The body portion B2 includes a curved portion 221 and an arm portion 222.

The curved portion 221 extends in a circumferential direction of the compressor impeller 9. The curved portion 221 has a substantially semicircular arc shape. One end surface 221*a* and the other end surface 221*b* of the curved portion 221 in the circumferential direction extend parallel to the radial direction and the rotational axis direction. However, the one end surface 221*a* and the other end surface 221*b* may be inclined with respect to the radial direction and the rotational axis direction.

The arm portion 222 is provided on a side of the one end surface 221*a* of the curved portion 221. The arm portion 222 extends radially outward from ah outer peripheral surface 221*c* of the curved portion 221. The arm portion 222 extends in a direction that is inclined with respect to the radial direction (toward the first movable member 210 side).

The curved portion 211 faces the curved portion 221 across the center of rotation of the compressor impeller 9 (intake flow path 130). The one end surface 211*a* of the curved portion 211 faces the other end surface 221*b* of the curved portion 221 in the circumferential direction. The other end surface 211*b* of the curved portion 211 faces the one end surface 221*a* of the curved portion 221 in the circumferential direction. The first movable member 210 and the second movable member 220 are configured so that the curved portions 211 and 221 are movable in the radial direction, as will be described in detail below.

The connecting member 230 is connected to the first movable member 210 and the second movable member 220. The connecting member 230 is positioned closer to the inlet 10 with respect to the first movable member 210 and the second movable member 220. The connecting member 230 has a substantially circular arc shape. The connecting member 230 has a first bearing hole 231 formed at one end in the circumferential direction and a second bearing hole 232 formed at the other end. In the connecting member 230, the first bearing hole 231 and the second bearing hole 232 are opened on an end surface 233 closer to the first movable member 210 and the second movable member 220. The first bearing hole 231 and the second bearing hole 232 are depressed in the rotational axis direction. In this embodiment, the first bearing hole 231 and the second bearing hole 232 are non-through holes. However, the first bearing hole 231 and the second bearing hole 232 may penetrate the connecting member 230 in the rotational axis direction.

In the connecting member 230, a rod connection portion 234 is formed between the first bearing hole 231 and the second bearing hole 232. In the connecting member 230, the rod connection portion 234 is formed on an end surface 235 opposite to the first movable member 210 and the second movable member 220. The rod connection portion 234 protrudes in the rotational axis direction from the end surface 235. The rod connection portion 234 has, for example, a substantially cylindrical shape.

The rod 240 has a substantially cylindrical shape. The rod 240 has a flat portion 241 formed at one end and a connecting portion 243 formed at the other end. The flat portion 241 extends in a plane direction substantially perpendicular to the rotational axis direction. A bearing hole 242 is opened in the flat portion 241. The bearing hole 242 extends in the rotational axis direction. The connecting portion 243 has a connecting hole 243*a*. An actuator (described below) is connected to the connecting portion 243 (the connecting hole 243*a*). The bearing hole 242 may be, for example, an elongated hole whose length in a direction perpendicular to the rotational axis direction and an axial direction of the rod 240 (left-to-right direction in FIG. 6 which will be described below) is longer than a length in the axial length of the rod 240.

The rod 240 includes a rod large diameter portion 244 and two rod small diameter portions 245 between the flat portion 241 and the connecting portion 243. The rod large diameter portion 244 is disposed between the two rod small diameters 245. Between the two rod small diameter portions 245, the rod small diameter portion 245 closer to the flat portion 241 connects the rod large diameter portion 244 with the flat portion 241. Between the two rod small diameter portions 245, the rod small diameter portion 245 closer to the connecting portion 243 connects the rod large diameter 24 4 with the connecting portion 243. An outer diameter of the rod large diameter portion 244 is larger than an outer diameter of the two rod small diameter portions 245.

An insertion hole 114 is formed in the first housing member 110. One end 114*a* of the insertion hole 114 opens to an outside of the first housing member 110. The insertion hole 114 extends, for example, in a plane direction perpendicular to the rotational axis direction. The insertion hole 114 is positioned radially outside the through hole 111 (intake flow path 130). A side including the flat portion 241 of the rod 240 is inserted into the insertion hole 114. The rod large diameter portion 244 is guided by an inner wall surface of the insertion hole 114. The rod 240 is restricted from moving in directions other than a central axis direction of the insertion hole 114 (the central axis direction of the rod 240).

An accommodation hole 115 is formed in the first housing member 110. The accommodation hole 115 is opened on the wall surface 112*c* of the accommodation groove 112*b*. The accommodation hole 115 is recessed from the wall surface 112*c* toward the inlet 10. The accommodation hole 115 is positioned spaced apart from the inlet 110 (closer to the second housing member 120) with respect to the insertion hole 114. The accommodation hole 115 has a substantially arc shape when seen from the rotational axis direction. The accommodation hole 115 extends longer than the connecting member 230 in the circumferential direction. The accommodation hole 115 is circumferentially spaced apart from the bearing hole 112*d*.

A connecting hole 116 is formed in the first housing member 110. The connecting hole 116 connects the insertion hole 114 with the accommodation hole 115. The connecting hole 116 is positioned at a substantially middle portion in the circumferential direction in the accommodation hole 115. The connecting hole 116 is, for example, an elongated hole extending substantially parallel to the extending direction of the insertion hole 114. The connecting hole 116 has a width in the longitudinal direction (extending direction) that is greater than a width in the lateral direction (perpendicular to the extending direction). The width in the lateral direction of the connecting hole 114 is greater than the outer diameter of the rod connection portion 234 of the connecting member 230.

The connecting member 230 is accommodated in the accommodation hole 115 (accommodation chamber AC). The first movable member 210, the second movable member 220, and the connecting member 230 are disposed in the accommodation chamber AC formed in the first housing member 110. The accommodation hole 115 has a longer circumferential length and a larger radial width than those of the connecting member 230. Therefore, the connecting member 230 is allowed to move inside the accommodation hole 115 in a plane direction perpendicular to the rotational axis direction.

The rod connection portion 234 is inserted from the connecting hole 116 into the insertion hole 114. The flat portion 241 of the rod 240 is inserted into the insertion hole 114. The bearing hole 242 of the flat portion 241 faces the connecting hole 116. The rod connection portion 234 is inserted into (connected to) the bearing hole 242. The rod connection portion 234 is supported by the bearing hole 242.

Figure 4:
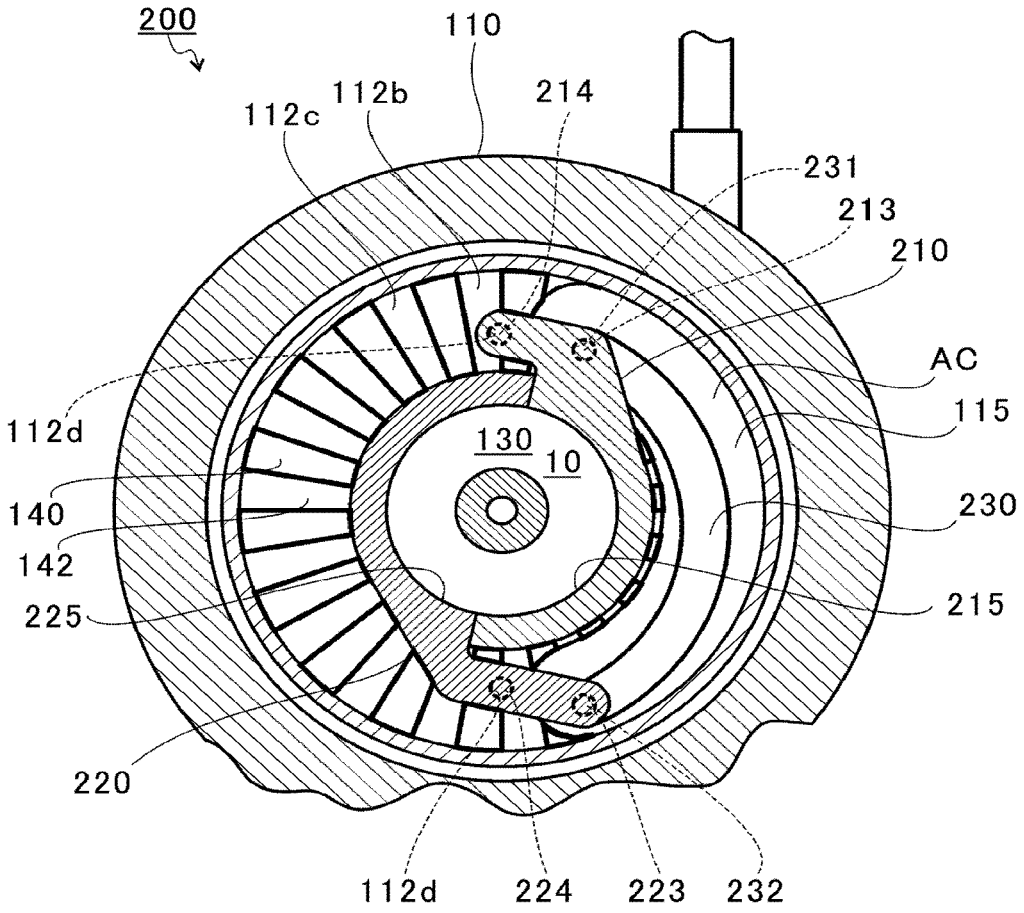
FIG. 4 is a cross-sectional view taken along IV-IV line in FIG. 2.

FIG. 4 is a cross-sectional view taken along line IV-IV in FIG. 2. As shown by dashed lines in FIG. 4, the first movable member 210 has a connecting shaft portion 213 and a rotational shaft portion 214. The connecting shaft portion 213 and the rotational shaft portion 214 protrude in the rotational axis direction from the opposing surface S1 (see FIG. 2) of the first movable member 210 that faces the wall surface 112*c*. The connecting shaft portion 213 and the rotational shaft portion 214 extend to the back side of the paper in FIG. 4. The rotational shaft portion 214 extends parallel to the connecting shaft portion 213. The connecting shaft portion 213 and the rotational shaft portion 214 have a substantially cylindrical shape.

The outer diameter of the connecting shaft portion 213 is smaller than the inner diameter of the first bearing hole 231 of the connecting member 230. The connecting shaft portion 213 is inserted into the first bearing hole 231. The connecting shaft portion 213 is rotatably supported by the first bearing hole 231. The outer diameter of the rotational shaft portion 214 is smaller than the inner diameter of the bearing hole 112*d* of the first housing member 110. Between the two bearing holes 112*d*, the rotational shaft portion 214 is inserted into the bearing hole 112*d* on the vertically upper side (proximate to the rod 240). The rotational shaft portion 214 is rotatably supported by the bearing hole 112*d*. The rotational shaft portion 214 connects the first movable member 210 with the wall surface 112*c* facing the first movable member 210 in the rotational axis direction.

The second movable member 220 includes a connecting shaft portion 223 and a rotational shaft portion 224. In the second movable member 220, the connecting shaft portion 223 and the rotational shaft portion 224 protrude in the rotational axis direction from the opposing surface S1 (see FIG. 2) facing the wall surface 112*c*. The connecting shaft portion 223 and the rotational shaft portion 224 extend to the back side of the paper in FIG. 4. The rotational shaft portion 224 extends parallel to the connecting shaft portion 223. The connecting shaft portion 223 and the rotational shaft portion 224 have a substantially cylindrical shape.

The outer diameter of the connecting shaft portion 223 is smaller than the inner diameter of the second bearing hole 232 of the connecting member 230. The connecting shaft portion 223 is inserted into the second bearing hole 232. The connecting shaft portion 223 is rotatably supported by the second bearing hole 232. The outer diameter of the rotational shaft portion 224 is smaller than the inner diameter of the bearing hole 112*d* of the first housing member 110. Between the two bearing holes 112*d*, the rotational shaft portion 224 is inserted into the bearing hole 112*d* on the vertically lower side (spaced apart from the rod 240). The rotational shaft portion 224 is rotatably supported by the bearing hole 112*d*. The rotational shaft portion 224 connects the second movable member 220 with the wall surface 112*c* facing the second movable member 220 in the rotational axis direction.

Accordingly, the link mechanism 200 includes a four-bar linkage. The four links (nodes) are the first movable member 210, the second movable member 220, the first housing member 110, and the connecting member 230. Since the link mechanism 200 includes a four-bar linkage, it is a limited chain and has one degree of freedom, making it easy to control.

Figure 5:
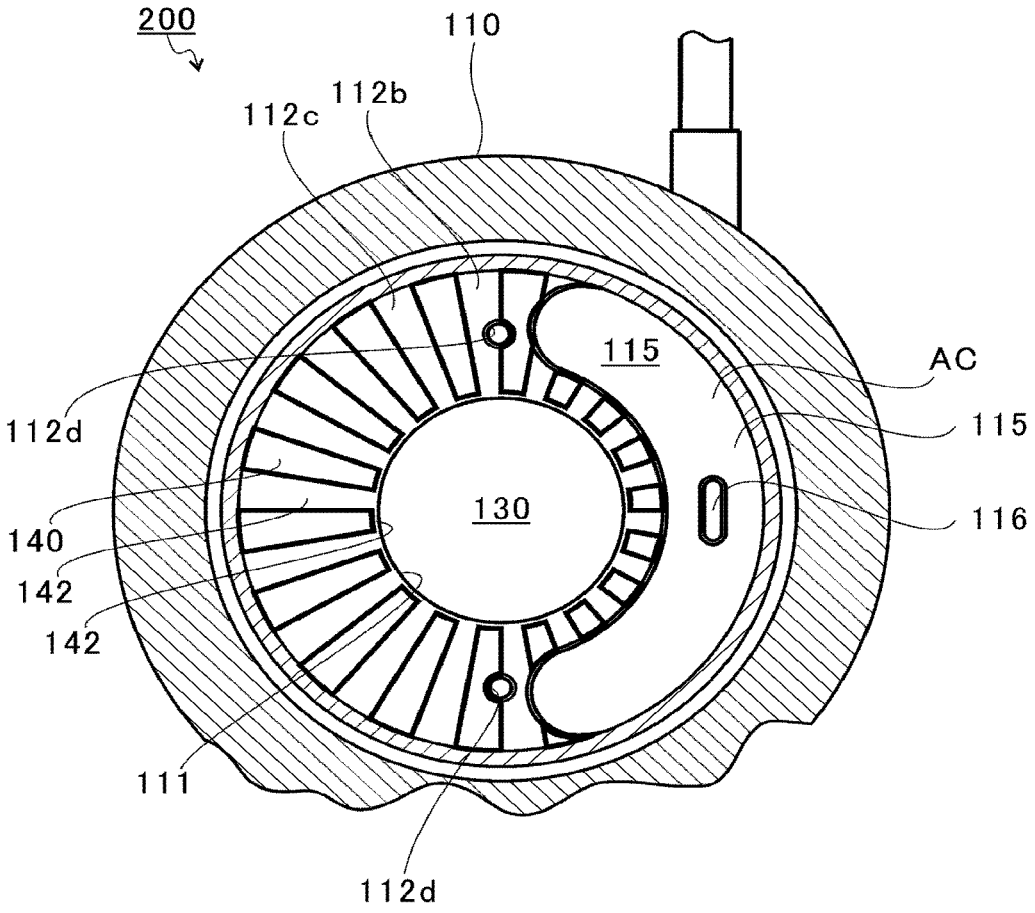
FIG. 5 shows a configuration of a wall surface of a first housing member in the embodiment.

FIG. 5 shows a configuration of the wall surface 112*c* of the first housing member 110 in the present embodiment. FIG. 5 shows the wall surface 112*c* of the first housing member 110 as seen from the second housing member 120.

As shown in FIG. 5, the wall surface 112*c* is provided with non-contacting portions 140 and contacting portions 142. The non-contacting portion 140 is a depressed portion that is depressed from the wall surface 112*c* toward the inlet 10 (see FIG. 3). The non-contacting portion 140 is a portion of the wall surface 112*c* that is not in contact with the first movable member 210 and the second movable member 220.

The non-contacting portions 140 extend radially (linearly) along the radial direction. However, the non-contacting portions 140 may extend with being inclined from the radial direction, or may extend in a curved shape. The plurality of non-contacting portions 140 is formed on the wall surface 112*c* along the circumferential direction. However, only one (single) non-contacting portion 140 may be formed on the wall surface 112*c*.

The non-contacting portion 140 is formed radially outside the through hole 111 (the intake flow path 130). The non-contacting portion 140 is formed in an area spaced apart from the through hole 111 (the intake flow path 130) radially outward. The non-contacting portion 140 extends from a position spaced apart from the through hole 111 (intake flow path 130) radially outward, to an outer peripheral edge of the wall surface 112*c*.

The contacting portion 142 is a portion of the wall surface 112*c* that is contactable with the first movable member 210 and the second movable member 220. In the wall surface 112*c*, the contacting portion 142 is formed in an area that is different from the area where the non-contacting portion 140 is formed. The contacting portions 142 are formed between the plurality of non-contacting portions 140.

A portion of the contacting portions 142 is formed between the non-contacting portion 140 and the through-hole 111 (the intake flow path 130). In other words, a portion of the contacting portions 142 is formed radially inside the non-contacting portion 140. A portion of the contacting portions 142 is arranged at the radially innermost area on the wall surface 112*c*.

The contacting portion 142 radially inside the non-contacting portion 140 is formed over the entire length of the wall surface 112*c* in the circumferential direction. In the present embodiment, the non-contacting portion 140 is configured not to be in communication with the through hole 111 (intake flow path 130).

Figure 6:
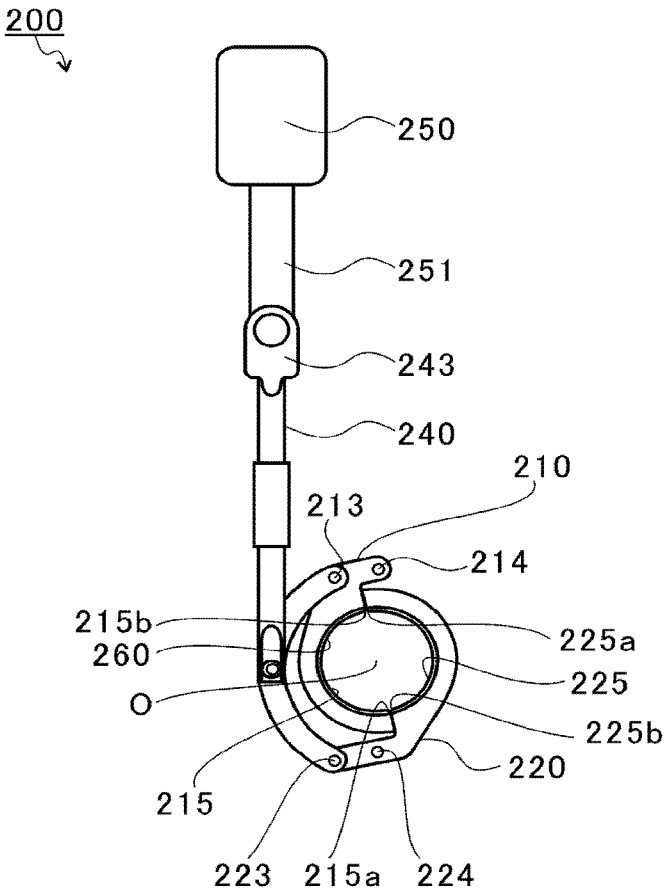
FIG. 6 is a first illustration of an operation of the link mechanism (throttling mechanism).

FIG. 6 is a first illustration of an operation of the link mechanism 200. In the following FIGS. 6, 7 and 8, the link mechanism 200 is seen from the inlet 10. As shown in FIG. 6, one end of the drive shaft 251 of the actuator 250 is connected to the connecting portion 243 of the rod 240.

In the arrangement shown in FIG. 6, the first movable member 210 and the second movable member 220 are in contact with each other. In this state, as shown in FIGS. 2 and 4, a protruding portion 215 that is an inner portion in the radial direction of the first movable member 210 protrudes (is exposed) into the intake flow path 130. A protruding portion 225 that is an inner portion in the radial direction of the second movable member 220 protrudes (is exposed) into the intake flow path 130. The positions of the first movable member 210 and the second movable member 220 in this state are referred to as a protruding position (or a throttle position).

As shown in FIG. 6, in the protruding position, the circumferential ends 215*a* and 215*b* of the protruding portion 215 and the circumferential ends 225*a* and 225*b* of the protruding portion 225 are in contact with each other. An annular hole 260 is formed by the protruding portion 215 and the protruding portion 225. An inner diameter of the annular hole 260 is smaller than an inner diameter of the intake flow path 130 at a position where the protruding portions 215 and 225 protrude. The inner diameter of the annular hole 260 is, for example, smaller than the inner diameter of the intake flow path 130 at any portions.

Figure 7:
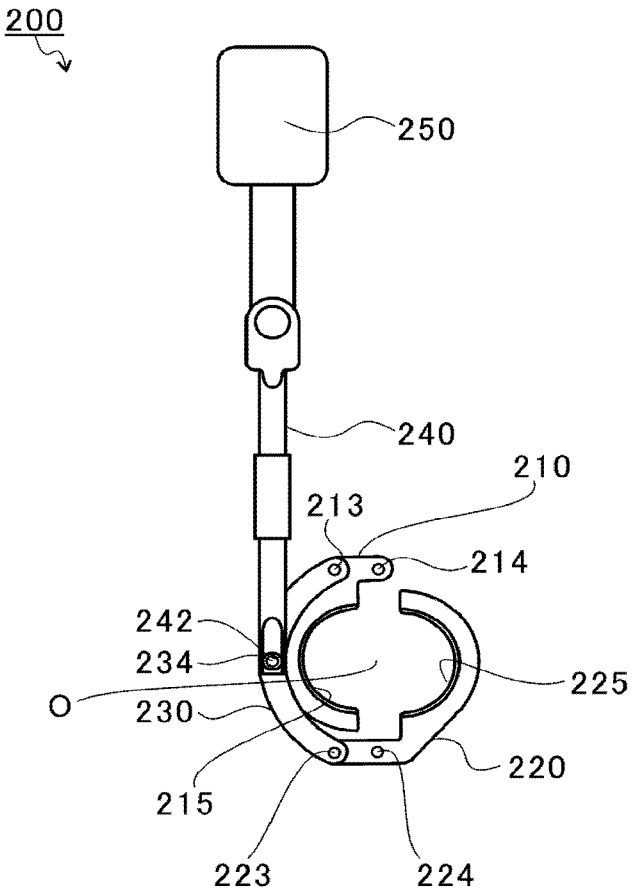
FIG. 7 is a second illustration of the operation of the link mechanism.
Figure 8:
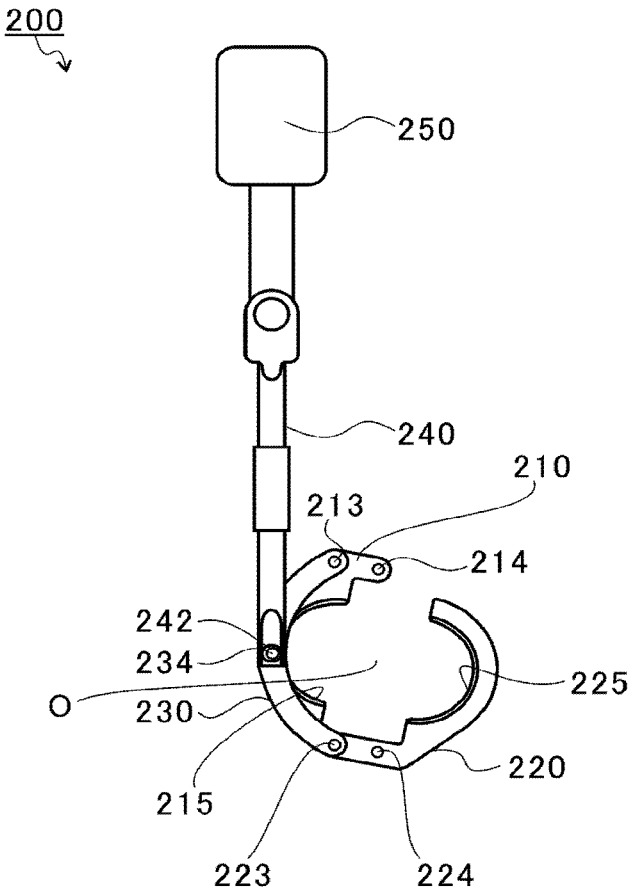
FIG. 8 is a third illustration of the operation of the link mechanism.

FIG. 7 is a second illustration of the operation of the link mechanism 200. FIG. 8 is a third illustration of the operation of the link mechanism 200. The actuator 250 linearly moves the rod 240 in a direction intersecting the rotational axis direction (up-and-down direction in FIGS. 7 and 8). The rod 240 moves upward from the state shown in FIG. 6. The amount of movement of the rod 240 relative to the arrangement shown in FIG. 6 is greater in the arrangement shown in FIG. 8 than in the arrangement shown in FIG. 7.

When the rod 240 moves, the connecting member 230 moves upward in FIGS. 7 and 8 through the rod connecting portion 234. In these states, the connecting member 230 is allowed to rotate around the rod connecting portion 234 as the center of rotation. There is a slight play in the inner diameter of the bearing hole 242 of the rod 240 relative to the outer diameter of the rod connecting portion 234. Therefore, the connecting member 230 is slightly allowed to move in the plane direction perpendicular to the rotational axis direction.

As described above, the link mechanism 200 is a four-bar linkage. The connecting member 230, the first movable member 210, and the second movable member 220 exhibit a behavior of one degree of freedom with respect to the first housing member 110. Specifically, the connecting member 230 slightly moves in the left-to-right direction while slightly rotating in the counterclockwise direction in FIGS. 7 and 8 within the above allowable range.

In the first movable member 210, the rotational shaft portion 214 is supported by the first housing member 110. The rotational shaft portion 214 is restricted from moving in the plane direction perpendicular to the rotational axis direction. The connecting shaft portion 213 is supported by the connecting member 230. Since the connecting member 230 is allowed to move, the connecting shaft portion 213 is movable in the plane direction perpendicular to the rotational axis direction. As a result, with the movement of the connecting member 230, the first movable member 210 rotates in a clockwise direction in FIGS. 7 and 8 around the rotational axis portion 214 as a rotation center.

Similarly, in the second movable member 220, the rotational shaft portion 224 is supported by the first housing member 110. The rotational shaft portion 224 is restricted from moving in the plane direction perpendicular to the rotational axis direction. The connecting shaft portion 223 is supported by the connecting member 230. Since the connecting member 230 is allowed to move, the connecting shaft portion 223 is movable in the plane direction perpendicular to the rotational axis direction. As a result, with the movement of the connecting member 230, the second movable member 220 rotates in a clockwise direction in FIGS. 7 and 8 around the rotational axis portion 224 as a rotation center.

Thus, the first movable member 210 and the second movable member 220 move in directions to separate from each other in the order of FIGS. 7 and 8. The protruding portions 215 and 225 move radially outward from the protruding position. The protruding portions 215 and 225 move radially outside the intake flow path 130 (see FIG. 2). The positions of the first movable member 210 and the second movable member 220 in this state are referred to as a retracted position. In the retracted position, for example, the protruding portions 215 and 225 are flush with the inner wall surface of the intake flow path 130 or are positioned radially outward from the inner wall surface of the intake flow path 130. When moving from the retracted position to the protruding position, the first movable member 210 and the second movable member 220 approach and contact with each other in the order shown in FIG. 8, FIG. 7, and FIG. 6. Thus, the first movable member 210 and the second movable member 220 switch between the protruding position and the retracted position according to the rotational angle around the rotational axis portions 214 and 224 as the rotation centers.

Thus, the first movable member 210 and the second movable member 220 are configured to be movable to the protruding position where they protrude into the intake flow path 130, and to the retracted position where they are not exposed (do not protrude) into the intake flow path 130. In the present embodiment, the first movable member 210 and the second movable member 220 move in the radial direction of the compressor impeller 9. However, the first movable member 210 and the second movable member 220 are not limited thereto, and may rotate around the rotational axis (circumferential direction) of the compressor impeller 9. For example, the first movable member 210 and the second movable member 220 may be shutter blades having two or more blades.

Since the first movable member 210 and the second movable member 220 do not protrude into the intake flow path 130 when they are in the retracted position (hereinafter also referred to as the retracted position state), the pressure loss of the intake air (air) flowing through the intake flow path 130 can be reduced.

As shown in FIG. 2, in the protruding position, the first movable member 210 and the second movable member 220 have the protruding portions 215 and 225 disposed in the intake air flow passage 130. When the first movable member 210 and the second movable member 220 are in the protruding position, the flow path cross-sectional area of the intake flow path 130 is reduced.

As the flow rate of the air flowing into the compressor impeller 9 decreases, the air compressed by the compressor impeller 9 may flow backward through the intake flow path 130 (i.e., the air may flow from the downstream side to the upstream side).

As shown in FIG. 2, when the first movable member 210 and the second movable member 220 are in the protruding position (hereinafter also referred to as the protruding position state), the protruding portions 215 and 225 are positioned radially inside the outermost diameter end of the leading edge LE of the compressor impeller 9. As a result, the air flowing backward in the intake flow path 130 is blocked by the protruding portions 215 and 225. Accordingly, the first movable member 210 and the second movable member 220 can curb the backflow of air in the intake flow passage 130.

In addition, since the flow path cross-sectional area of the intake flow path 130 is reduced, a velocity of the air flowing into the compressor impeller 9 is increased. As a result, a surging in the centrifugal compressor CC can be inhibited. In other words, the centrifugal compressor CC of the present embodiment can expand the operational range of the centrifugal compressor CC to the smaller flow rate area by forming the protruding position state.

In this manner, the first movable member 210 and the second movable member 220 are configured as a throttling member that decreases the intake flow path 130. In the present embodiment, the link mechanism 200 is configured as a throttling mechanism that decreases the intake flow path 130. The first movable member 210 and the second movable member 220 can change the flow path cross-sectional area of the intake flow path 130 by operating the link mechanism 200.

When the first movable member 210 and the second movable member 220 are in the protruding position, they are pressed against the wall surface 112*c* (the compressor housing 100) toward the upstream side in the flow of the intake air, by the air flowing backward in the intake flow path 130. In this state, a frictional force increases between the wall surface 112*c* and the first movable member 210 and the second movable member 220.

When the first movable member 210 and the second movable member 220 are pressed against the wall surface 112*c*, a gap is formed between the opposing surfaces S2 (see FIG. 2) of the first movable member 210 and the second movable member 220 and the wall surface 122*b* (see FIG. 2) of the second housing member 120. The air flowing backward in the intake flow path 130 flows into the accommodation chamber AC through the gap between the opposing surfaces S2 of the first movable member 210 and the second movable member 220 and the wall surface 122*b*. The air that flows into the accommodation chamber AC stays in the accommodation chamber AC.

In this state, a pressure in the accommodation chamber AC that is radially outside the first movable member 210 and the second movable member 220 is larger than a pressure in the intake flow path 130 that is radially inside the first movable member 210 and the second movable member 220. This makes the link mechanism 200 difficult to move the first movable member 210 and the second movable member 220 radially outward.

Thus, in the protruding position state, the load of the link mechanism 200 increases when moving the first movable member 210 and the second movable member 220.

Therefore, the compressor housing 100 of the present embodiment includes the non-contacting portions 140 and the contacting portions 142 on the wall surface 112*c* positioned upstream of the first movable member 210 and the second movable member 220 in the flow of the intake air, in the accommodation chamber AC.

The air flowing backward in the intake flow path 130 and flowing into the accommodation chamber AC flows into the non-contacting portion 140 formed in the wall surface 112*c* of the accommodation chamber AC. The air flowing into the non-contacting portion 140 presses the opposing surfaces (movable member opposing surfaces) S1 of the first movable member 210 and the second movable member 220 that faces the wall surface 112*c*. The air flowing into the non-contacting portion 140 presses the first movable member 210 and the second movable member 220 (the opposing surfaces S1) in a direction spaced apart from the wall surface 112*c*.

Accordingly, the frictional force between the wall surface 112*c* and the opposing surfaces S1 of the first movable member 210 and the second movable member 220 is reduced. As a result, the link mechanism 200 can reduce the load when driving the first movable member 210 and the second movable member 220 in the protruding position state.

In addition, the portion of the contacting portions 142 is arranged at the radially innermost area on the wall surface 112*c*. In other words, the contacting portion 142 is disposed between the non-contacting portion 140 and the through hole 111 (the intake flow path 130). In the contacting portion 142, the wall surface 112*c* and the first movable member 210 and the second movable member 220 are in contact with each other. The contacting portion 142 inhibits the air that flows into the non-contacting portion 140 from flowing out to the intake flow path 130. Therefore, the air that flows into the non-touching portion 140 can sufficiently press the first movable member 210 and the second movable member 220 (opposing surfaces S1) in the direction spaced apart from the wall 112*c*.

(Variant)

Figure 9:
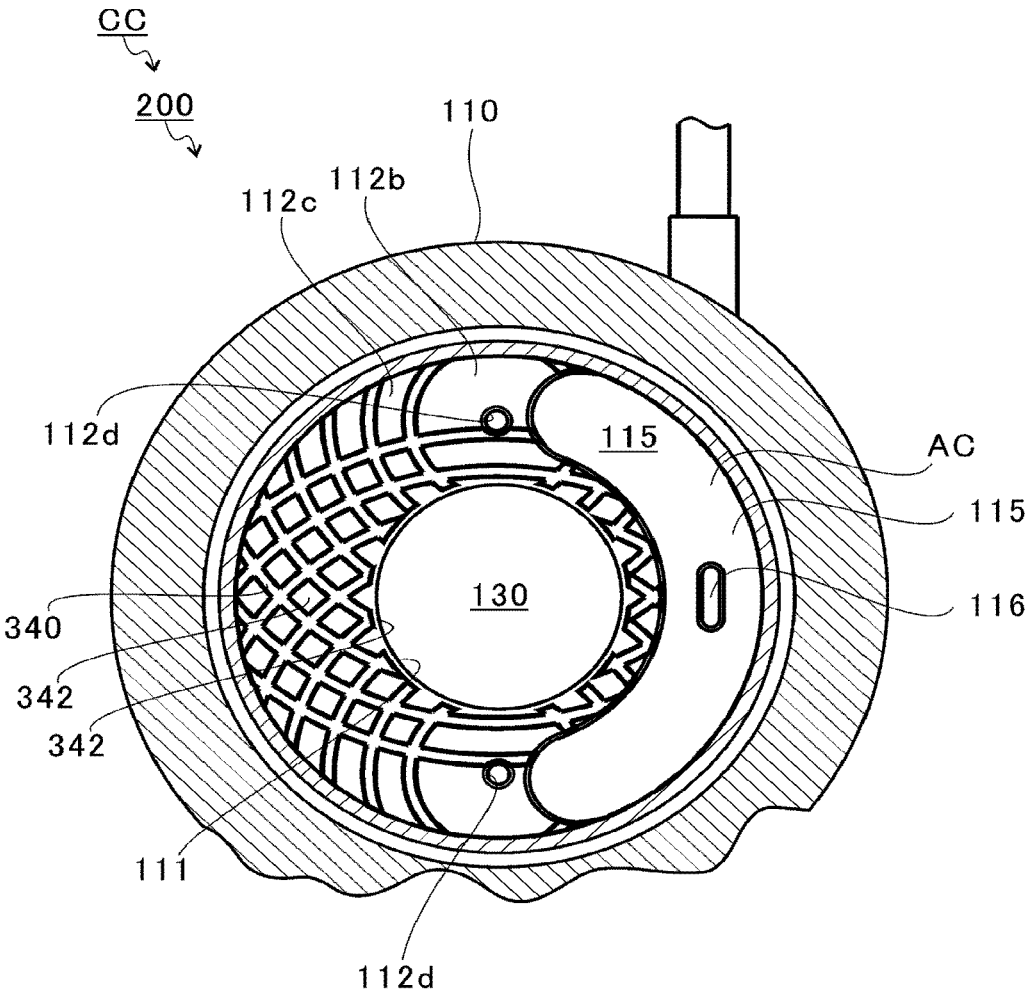
FIG. 9 shows a configuration of the wall of the first housing member in a variation.

FIG. 9 shows a configuration of the wall 112*c* of the first housing member 110 in a variant. Components that are substantially the same as those of the centrifugal compressor CC of the above embodiment are marked with the same reference signs and are omitted from the descriptions. In the centrifugal compressor CC of this variation, the shapes of a non-contacting portion 340 and a contacting portion 342 formed in the wall surface 112*c* are different from the shapes of the non-contacting portion 140 and the contacting portion 142 of the above embodiment.

As shown in FIG. 9, non-contacting portions 340 and contacting portions 342 are provided in the wall surface 112*c* of this variation. The non-contacting portion 340 is a depressed portion that is depressed from the wall surface 112*c* toward the inlet 10 (see FIG. 3). The non-contacting portion 340 is a portion of the wall surface 112*c* that is not in contact with the first movable member 210 and the second movable member 220.

The non-contacting portion 340 extends in an arc shape (curved shape) around the central axes of the bearing holes 112*d*. The non-contacting portion 340 is formed in a substantially annular shape so as to surround the bearing hole 112*d*. A plurality of substantially annular non-contacting portions 340 are formed on the wall surface 112*c* around the central axes of the bearing holes 112*d*.

In this variation, two bearing holes 112*d* are formed in the wall 112*c*. The substantially annular non-contacting portions 340 are formed to surround each of the two bearing holes 112*d*. Therefore, at least two substantially annular non-contacting portions 340 are formed on the wall surface 112*c*. However, at least one substantially annular non-contacting portion 340 may be formed on the wall surface 112*c* to surround one of the two bearing holes 112*d*.

The non-contacting portions 340 are formed at least in a movable range of the first movable member 210 and the second movable member 220. The non-contacting portions 340 are formed on a movement path of corner parts in the first movable member 210 and the second movable member 220 (e.g., an outer diameter end and an inner diameter end of the one end surface 211*a* and 221*a*, and an outer diameter end and an inner diameter end of the other end surface 211*b* and 221*b* shown in FIG. 3).

The substantially annular non-contacting portions 340 surrounding each of the two bearing holes 112*d* have the same inner diameter as each other. However, the substantially annular non-contacting portions 340 surrounding each of the two bearing holes 112*d* may have different inner diameters from each other.

The non-contacting portion 340 is formed radially outside the through hole 111 (the intake flow path 130). In other words, the non-contacting portion 340 is formed in an area spaced apart from the through hole 111 (intake flow path 130) radially outward. The non-contacting portion 340 extends from a position spaced apart from the through hole 111 (the intake flow path 130) radially outward, to the outer peripheral edge of the wall surface 112*c*.

In the wall surface 112*c*, the contacting portion 342 is formed in an area that is different from an area where the non-contacting portion 340 is formed. The contacting portions 342 are formed between the plurality of non-contacting portions 340. A portion of the contacting portions 342 is formed between the non-contacting portions 340 and the through holes 111 (intake flow paths 130). A portion of the contacting portions 342 is arranged at the radially innermost area on the wall surface 112*c*. In this variation, the non-contacting portion 340 is configured not to be in communication with the through hole 111 (intake flow path 130).

Thus, according to the present variation, the compressor housing 100 includes the non-contacting portions 340 and the contacting portions 342 on the wall surface 112*c* positioned upstream of the first movable member 210 and the second movable member 220 in the flow of the intake air, in the accommodation chamber AC. Therefore, the same action and effect as the above embodiment can be achieved.

According to the present variation, the non-contacting portions 340 extend around the central axes of the bearing holes 112*d*. Therefore, when the first movable member 210 and the second movable member 220 rotate around the central axes of the bearing holes 112*d* (rotational shaft portions 214 and 224 (see FIG. 4)), the first movable member 210 and the second movable member 220 are difficult to be caught at boundary portions between the non-contacting portions 340 and the contacting portions 342. As a result, the link mechanism 200 can reduce the load when driving the first movable member 210 and the second movable member 220 in the protruding position state.

Although the embodiments of the present disclosure have been described above with reference to the accompanying drawings, the present disclosure is not limited thereto. It is obvious that a person skilled in the art can conceive of various examples of variations or modifications within the scope of the claims, which are also understood to belong to the technical scope of the present disclosure.

In the above embodiment and variation, examples in which the contacting portions 142, 342 are arranged at the radially innermost area on the wall surface 112*c* are described. However, the contacting portions 142, 342 are not limited thereto, and do not need to be arranged at the radially innermost area on the wall surface 112*c*.

In the above embodiment and variation, examples in which the contacting portions 142, 342 are arranged between the non-contacting portions 140, 340 and the intake flow path 130 are described. However, the contacting portions 142, 342 are not limited thereto, and may not be arranged in at least a part of the space between the non-contacting portions 140, 340 and the intake flow path 130. For example, the contacting portions 142, 342 may not be arranged between the non-contacting portions 140, 340 and the intake flow path 130. Also, the contacting portions 142, 342 may be provided with a connecting hole that connects the non-contacting portions 140, 340 with the intake flow path 130. In this manner, the non-touching portions 140, 340 may be connected to the intake flow path 130. By connecting the non-contacting portions 140, 340 with the intake flow path 130, high-pressure air in the accommodation chamber AC that is radially outside the first movable member 210 and the second movable member 220 can flow out into the intake flow path 130 that is radially inside the first movable member 210 and the second movable member 220. As a result, the link mechanism 200 can make it easier to move the first movable member 210 and the second movable member 220 radially outward. Therefore, the link mechanism 200 can reduce the load in driving the first movable member 210 and the second movable member 220 in the protruding position state. In contrast, when the contacting portions 142, 342 are arranged between the non-contacting portions 140, 340 and the intake flow path 130, it is difficult for the air to flow out of the non-contacting portions 140, 340 to the intake flow path 130. Therefore, it is difficult for the air in the accommodation chamber AC to mix with the air flowing in the intake flow path 130, and a mixing loss can be reduced (and thus a compressor efficiency loss can also be reduced).

The first movable member 210 and the second movable member 220 may be provided with through holes that penetrate the body portions B1, B2 in the radial direction. This allows the high-pressure air in the accommodation chamber AC that is radially outside the first movable member 210 and the second movable member 220 to flow out into the intake flow path 130 that is radially inside the first movable member 210 and the second movable member 220. As a result, the link mechanism 200 can make it easier to move the first movable member 210 and the second movable member 220 radially outward. Accordingly, the link mechanism 200 can reduce the load in driving the first movable member 210 and the second movable member 220 in the protruding position state.

What is claimed is:

1. A centrifugal compressor comprising:

a housing including an intake flow path;

a compressor impeller disposed in the intake flow path;

an accommodation chamber formed upstream of the compressor impeller in a flow of an intake air in the housing; and a movable member disposed in the accommodation chamber and configured to be movable in a radial direction of the compressor impeller between a retracted position where the movable member is retracted from the intake flow path and a protruding position where the movable member protrudes from the accommodation chamber into the intake flow path, wherein the accommodation chamber includes a wall surface positioned upstream of the movable member and facing the movable member in an axial direction of the compressor impeller, and wherein the wall surface includes a contacting portion that is contactable with the movable member in the axial direction, and a non-contacting portion that is non-contactable with the movable member, the non-contacting portion being a depressed portion that is depressed from the wall surface toward an inlet of the housing.

2. The centrifugal compressor according to claim 1, wherein the contacting portion is arranged at the radially innermost area of the wall surface.

3. The centrifugal compressor according to claim 1, wherein the non-contacting portion communicates with the intake flow path.

4. The centrifugal compressor according to claim 2, wherein the non-contacting portion communicates with the intake flow path.

5. The centrifugal compressor according to claim 1, wherein the non-contacting portion extends from a position spaced apart from the intake flow path radially outward to an outer peripheral edge of the wall surface.

6. The centrifugal compressor according to claim 5, wherein the contacting portion is formed radially inside the non-contacting portion over an entire length of the wall surface.

* * * * *